US008640384B2

(12) United States Patent
Curtis

(10) Patent No.: US 8,640,384 B2
(45) Date of Patent: Feb. 4, 2014

(54) MULTI-POINT LOCK SYSTEM WITH SINGLE POSITION ACTUATION AND RELATED METHODS

(75) Inventor: Daniel J. Curtis, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 241 days.

(21) Appl. No.: 12/902,671

(22) Filed: Oct. 12, 2010

(65) Prior Publication Data

US 2011/0107672 A1 May 12, 2011

Related U.S. Application Data

(60) Provisional application No. 61/250,145, filed on Oct. 9, 2009.

(51) Int. Cl.
*E05C 9/00* (2006.01)

(52) U.S. Cl.
USPC ..... 49/395

(58) Field of Classification Search
USPC ..... 49/395, 449; 70/89, 90, 95, 97, 98, 99, 70/100, 103, 108, 113; 292/32, 33, 34, 37, 292/38, 40, 42, 137, 138, 140, 141, 143, 292/145, 163, 164, 169, 171, 173, 175, 292/DIG. 31, DIG. 68
See application file for complete search history.

(56) References Cited

U.S. PATENT DOCUMENTS 4,639,021 A * 1/1987 Hope ..... 292/7
4,643,005 A * 2/1987 Logas ..... 70/95
5,326,141 A 7/1994 Gorman
5,394,718 A * 3/1995 Hotzl ..... 70/283.1
5,878,606 A * 3/1999 Chaput et al. ..... 70/108
5,906,403 A * 5/1999 Bestler et al. ..... 292/26
5,992,907 A * 11/1999 Sheldon et al. ..... 292/34
6,264,252 B1 * 7/2001 Clancy ..... 292/196
6,282,929 B1 * 9/2001 Eller et al. ..... 70/109
6,354,639 B1 3/2002 Minter et al.
6,367,853 B1 4/2002 Briggs
6,651,389 B2 11/2003 Minter et al.
6,871,451 B2 * 3/2005 Harger et al. ..... 49/449
6,938,377 B2 9/2005 Gorman
6,962,377 B2 * 11/2005 Tonges ..... 292/332
D520,335 S 5/2006 Gorman
D558,024 S 12/2007 Tremble et al.
7,353,637 B2 * 4/2008 Harger et al. ..... 49/449
7,452,014 B2 11/2008 Vetter (Continued)

OTHER PUBLICATIONS

"Innovation Key to Ease-of-Use and Accessibility", © 2010 Milgard Manufacturing, Inc., (2010), 8 pgs.

*Primary Examiner* — Jerry Redman
(74) *Attorney, Agent, or Firm* — Schwegman Lundberg & Woessner, P.A.

(57) ABSTRACT

A sliding fenestration assembly including a panel assembly having at least a primary panel and a secondary panel, where the primary panel is slidable relative to the secondary panel. The assembly further includes an actuator assembly having an actuator. The actuator assembly is coupled with an element, and movement of the actuator causes movement of the element. One or more locking latches are disposed remotely from the actuator, and the two or more locking latches having a locked and unlocked position. The two or more locking latches are coupled with the element and mounted along the primary panel. The actuator assembly is adapted to unlock the two or more locking latches and slide the primary panel.

24 Claims, 15 Drawing Sheets

(56) References Cited

U.S. PATENT DOCUMENTS

| | | | | |
|---|---|---|---|---|
| 7,533,496 | B2 | 5/2009 | Tremble et al. | |
| 7,823,935 | B2 | 11/2010 | Norris et al. | |
| 2002/0104339 | A1* | 8/2002 | Saner | 70/108 |
| 2005/0092042 | A1* | 5/2005 | Constantinou et al. | 70/107 |
| 2005/0144848 | A1* | 7/2005 | Harger et al. | 49/449 |
| 2007/0137109 | A1 | 6/2007 | Tremble et al. | |
| 2008/0129054 | A1 | 6/2008 | Tremble et al. | |
| 2008/0150300 | A1* | 6/2008 | Harger et al. | 292/32 |
| 2009/0019779 | A1* | 1/2009 | Nakanishi et al. | 49/449 |
| 2010/0327612 | A1 | 12/2010 | Liebel et al. | |

* cited by examiner

MULTI-POINT LOCK SYSTEM WITH SINGLE POSITION ACTUATION AND RELATED METHODS

RELATED MATTER

This document is a continuation-in-part and claims priority to Provisional Application Ser. No. 61/250,145 filed on Oct. 9, 2009, which is incorporated herein by reference.

TECHNICAL FIELD

The present disclosure relates to a multi-point lock system and single position actuation for a fenestration assembly and related methods.

TECHNICAL BACKGROUND

Sliding fenestration units such as sliding doors and windows typically have a cam lock, and require that a user unlock each locking point separately prior to opening the sash or panel, requiring the use of more than one hand to unlock and open the fenestration unit.

SUMMARY

A sliding fenestration assembly is provided including a panel assembly having at least a primary panel and a secondary panel, where the primary panel is slidable relative to the secondary panel. The assembly further includes an actuator assembly having an actuator. The actuator assembly is coupled with an element, such as, but not limited to, a flexible element, and movement of the actuator causes movement of the flexible element. One or more locking latches, such as, but not limited to, two or more locking latches, are disposed remotely from the actuator, and the one or more locking latches having a locked and unlocked positions. The one or more locking latches are coupled with the element and are mounted along the primary panel. The actuator assembly is adapted to unlock the one or more locking latches and slide the primary panel in the unlocked position.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

BRIEF DESCRIPTION OF THE DRAWINGS

In the drawings, like numerals describe substantially similar components throughout the several views. Like numerals having different letter suffixes represent different instances of similar components. The drawings illustrate generally, by way of example, but not by way of limitation, various embodiments discussed in the present document.

DESCRIPTION OF THE EMBODIMENTS

The following detailed description includes references to the accompanying drawings, which form a part of the detailed description. The drawings show, by way of illustration, specific embodiments in which the present fenestration assemblies and methods may be practiced. These embodiments, which are also referred to herein as "examples," are described in enough detail to enable those skilled in the art to practice the present fenestration assemblies and methods. The embodiments may be combined, other embodiments may be utilized or structural or logical changes may be made without departing from the scope of the present fenestration assemblies and methods. The following detailed description is, therefore, not to be taken in a limiting sense, and the scope of the present fenestration assemblies and methods is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

Figure 1:
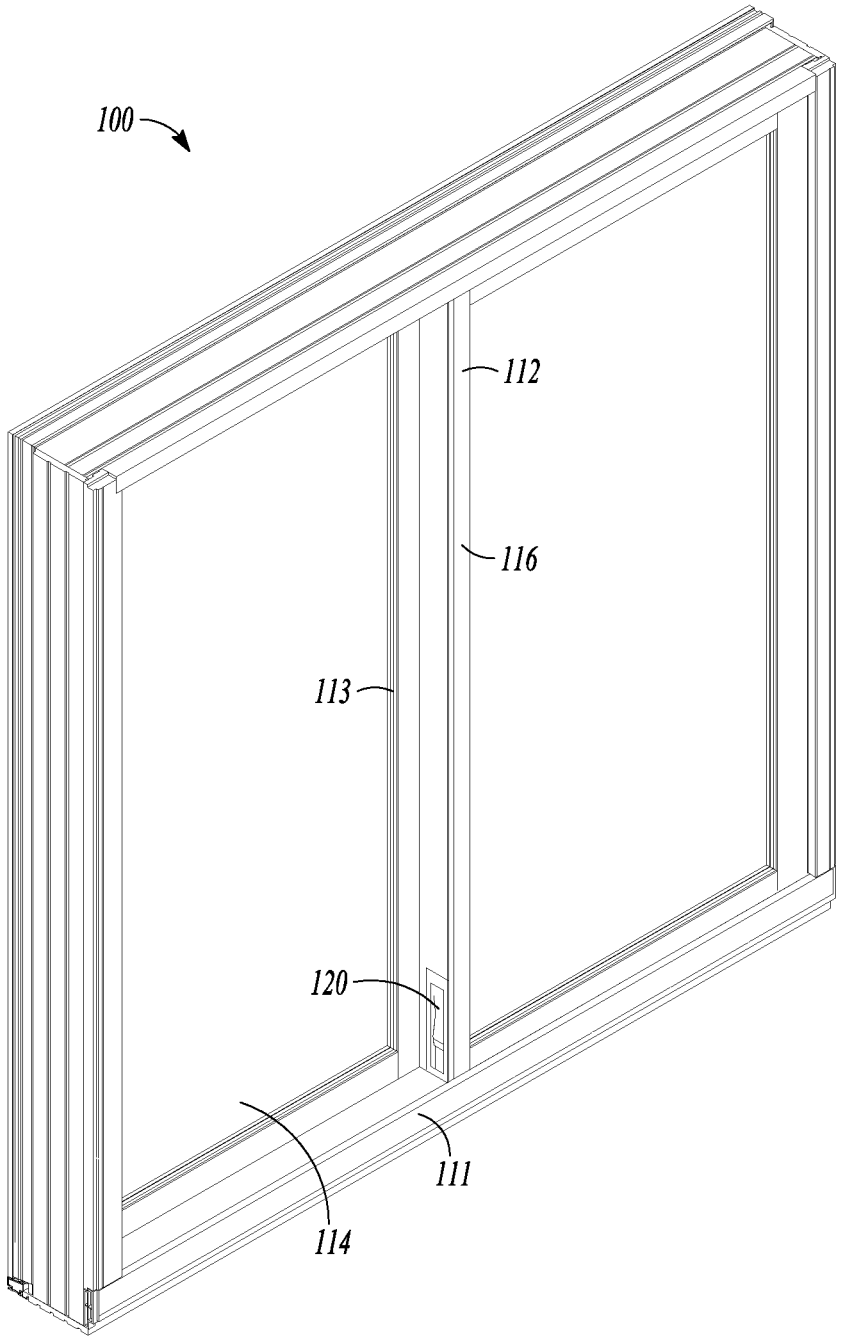
FIG. 1 is a perspective view of a sliding fenestration assembly as constructed in accordance with at least one embodiment.
Figure 2:
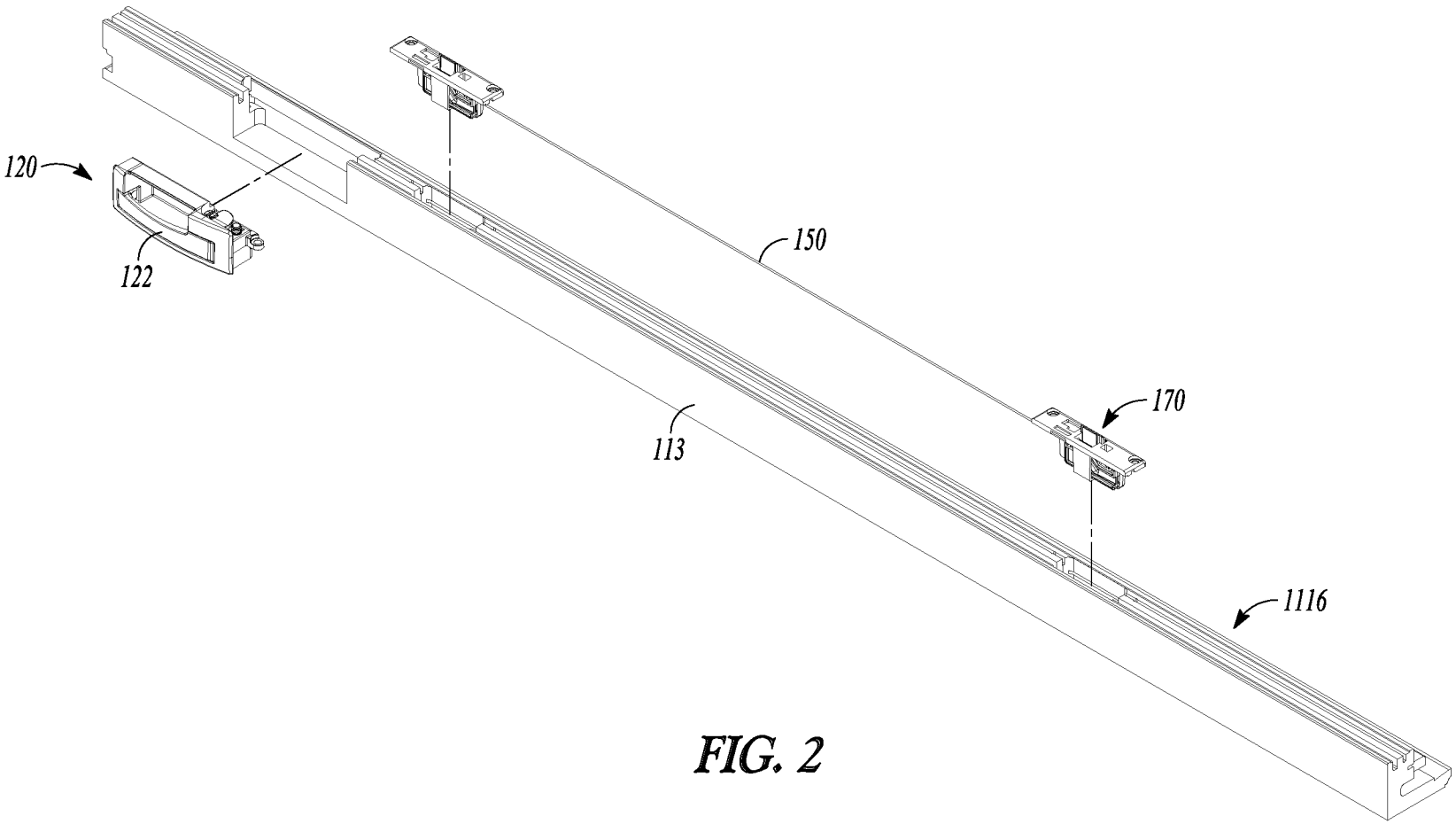
FIG. 2 is an exploded perspective view of a portion of a sliding fenestration assembly in accordance with at least one embodiment.
Figure 3:
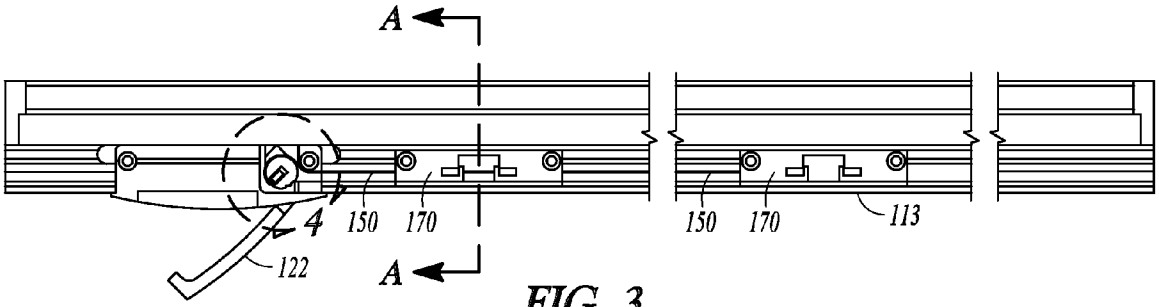
FIG. 3 is a cross-sectional view of a portion of a sliding fenestration assembly in accordance with at least one embodiment.
Figure 4:
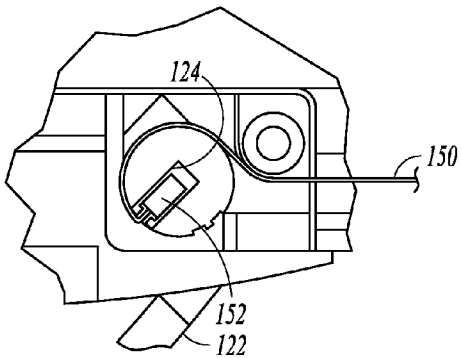
FIG. 4 is an enlarged view of an actuator assembly as constructed in accordance with at least one embodiment.
Figure 5:
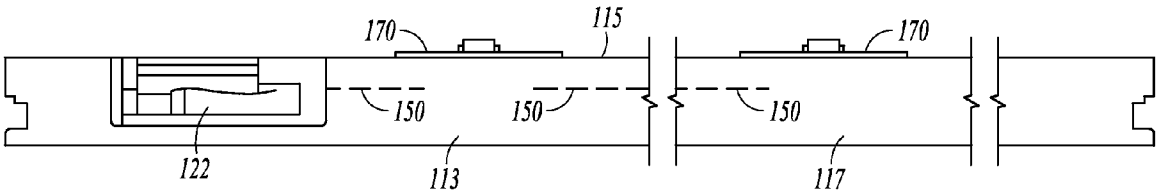
FIG. 5 is a side view of a portion of a sliding fenestration assembly in accordance with at least one embodiment.
Figure 8:
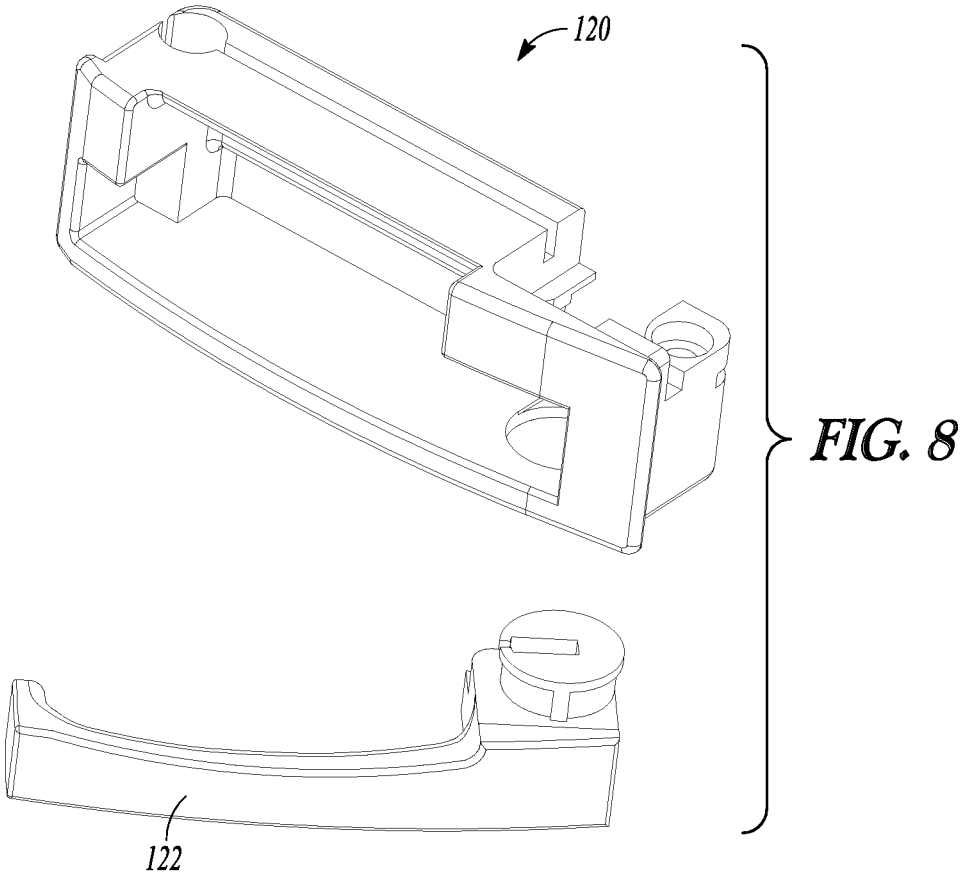
FIG. 8 is an exploded perspective view of an actuator assembly as constructed in accordance with at least one embodiment.

FIG. 1 illustrates an example of a sliding fenestration assembly 100. The sliding fenestration assembly 100 includes in an option a single sliding panel assembly, with a sliding primary panel 112, and a secondary panel 114. The secondary panel 114 may be a fixed, stationary panel, or also a sliding panel. It should be noted that additional panels can be used as well. The primary panel 112 includes an actuator assembly 120 including an actuator 122, as shown in FIGS. 2-4. The actuator assembly 120, in an option includes a lever coupled with a rotatable barrel (e.g., a spindle), where the lever rotates the barrel, as shown in FIG. 8.

The actuator assembly 120 is mounted in a primary meeting stile 116, and in an option internal to the meeting stile 116. The actuator assembly 120 is coupled with an element 150 (e.g., a transmission element configured for transmitting one or more of pushing and pulling forces), such as a flexible element, which is further coupled with one or more locking latch assemblies 170, as shown in FIGS. 2-5. The system including the actuator assembly 120 as well as the element 150 and the one or more locking latch assemblies 170 is a remotely operated locking system for the sliding fenestration assembly 100 shown. Stated another way, the actuator assembly 120 is used to operate locking latch assemblies 170 at remote positions relative to an actuator 122 by way of the element 150. As described in further detail below, operation of the actuator assembly 120 remotely facilitates locking, unlocking and opening and closing of the sliding fenestration assembly with a single system. Element 150 could also be a rigid bar or rod. The actuator 122 is moved, for instance with a single hand, which causes movement of the element 150. In an option, the element 150 is coupled with the actuator 122. For example, the element 150 includes a crimp 152 that fits within a slot 124 of the actuator 122. The element 150 can be coupled with the actuator 122 in other ways, such as riveting or pinning the element such as a rod into a portion of the handle barrel, such as in a hole of the handle barrel.

Figure 6:
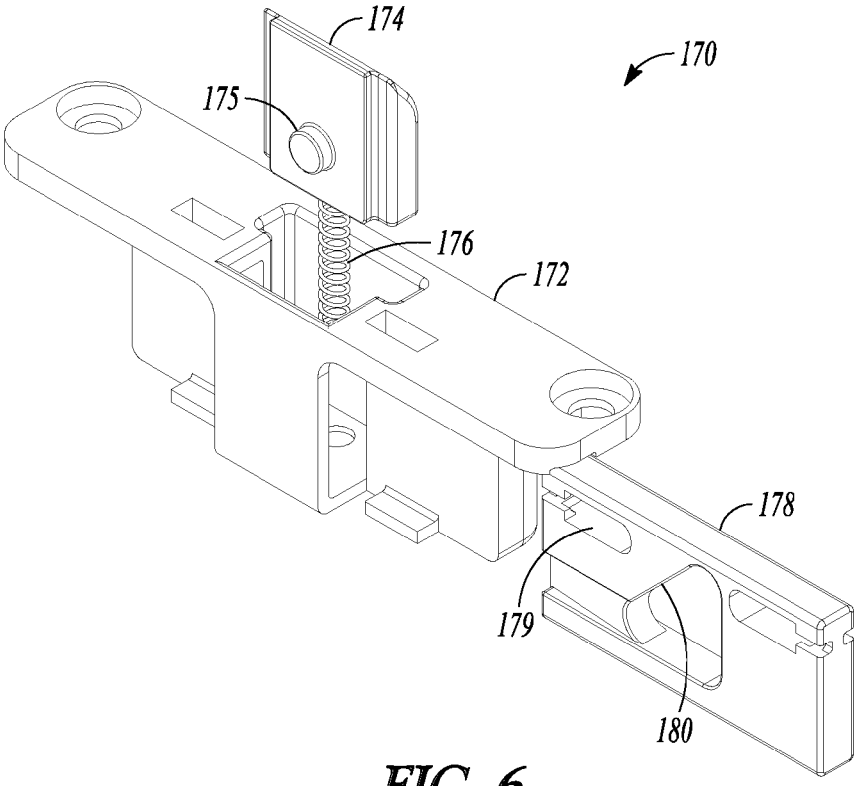
FIG. 6 is an exploded perspective view of a locking latch assembly as constructed in accordance with at least one embodiment.
Figure 7:
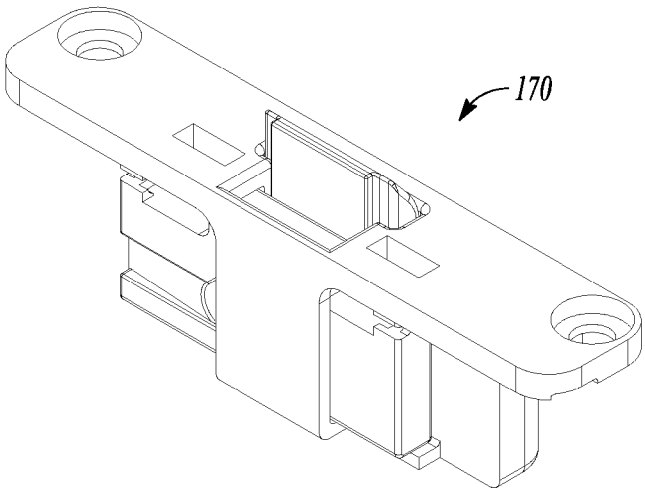
FIG. 7 is an assembled perspective view of a locking latch assembly as constructed in accordance with at least one embodiment.
Figure 9:
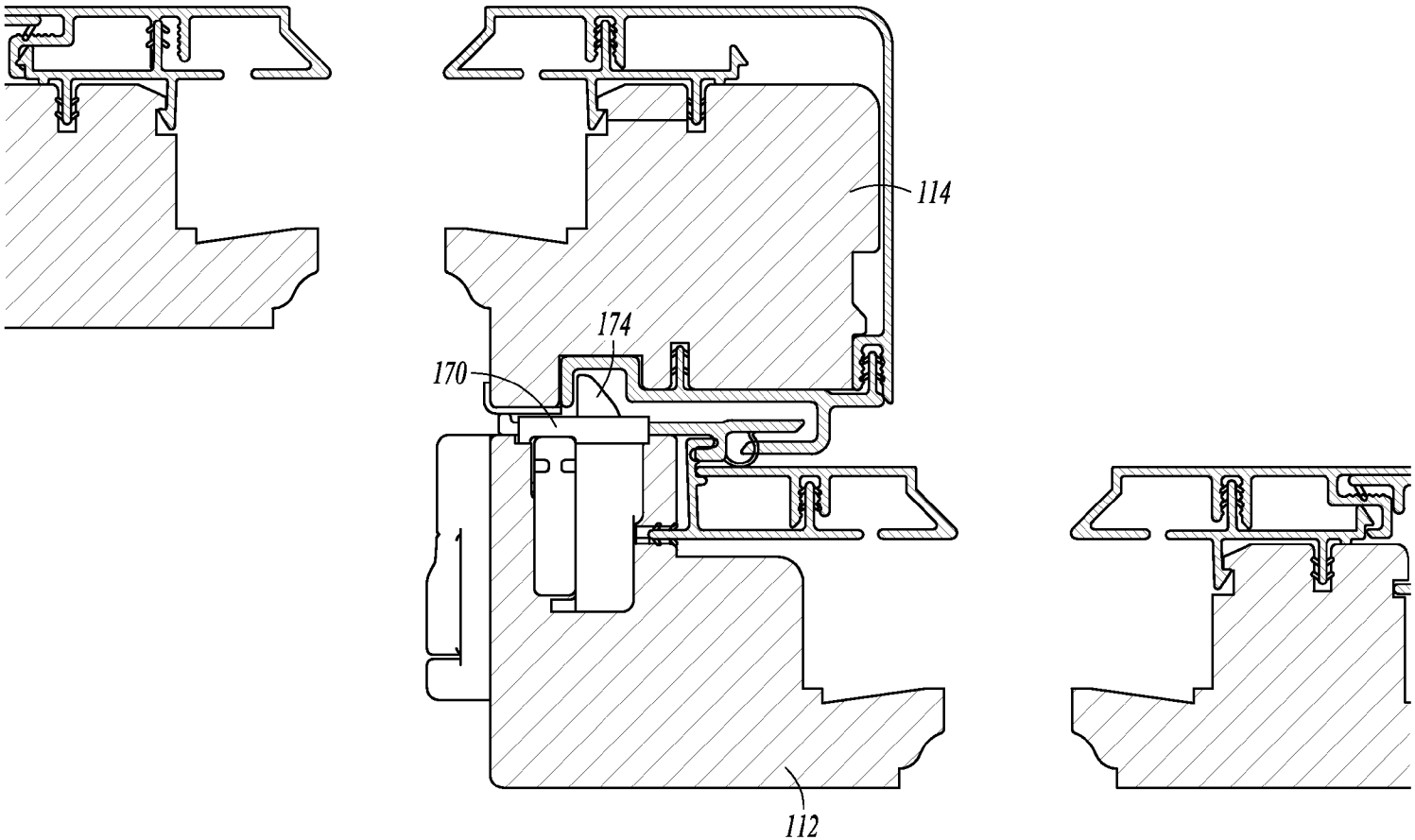
FIG. 9 is a cross-sectional view of a sliding fenestration assembly in the locked position taken along line A-A in FIG. 3.
Figure 10:
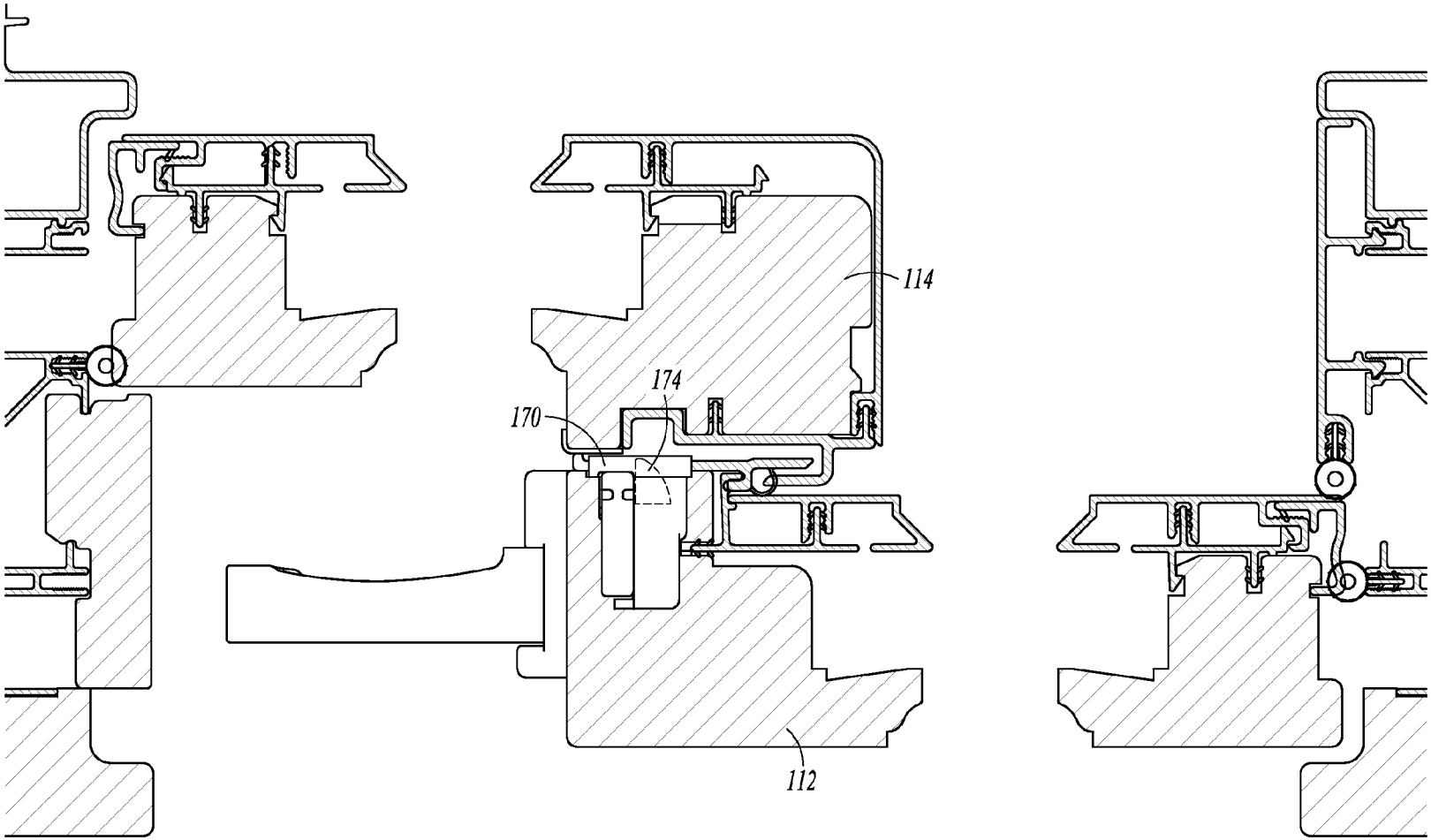
FIG. 10 is a cross-sectional view of a sliding fenestration assembly in the unlocked position taken along line A-A in FIG. 3.

The locking latch assemblies 170, shown in more detail in FIGS. 6 and 7 are mounted remote to the actuator assembly 120. Stated another way, one or more of the lock latch assemblies 170 are spaced from the actuator assembly 120. The locking latch assemblies 170 are interconnected with the flexible element 150, and are further coupled with the actuator assembly 120 with the flexible element 150 (FIG. 2). In an option, the assemblies 170 include a lock latch housing 172 that receives a latch 174, such as a locking latch bolt 174, and spring 176 therein. The lock latch bolt 174 includes a pin 175 that rides within slot ramp 180 of the lock latch slide 178. The lock latch slide 178 moves relative to the housing 172 as the actuator 122 moves the flexible element 150. The flexible or rigid element 150 is coupled with the lock latch slide 178, for instance in slot 179, allowing for movement of the actuator and flexible or rigid element 150 to cause movement of the lock latch slide 178. As the pin 175 rides along slot ramp 180 due to movement of the lock latch slide 178, the pin 175 will ride down the ramp slot and retract the latch bolt 174. This moves assembly 170 from a locked position, as shown in FIG. 9, to an unlocked position, as shown in FIG. 10.

Multiple locking latch assemblies 170 can be unlocked with an actuator 122 which is remote from the locking assemblies 170, and further can be done with a single handed operation. This is helpful for larger units where the locking assemblies are too high for a user to reach, or in too difficult of a position for the user to reach, such as above a wide sink. The assembly allows for multiple lock points along the mating stiles to be unlocked or disengaged by using an actuation handle in one location. The single location of the actuation handle allows for locating the lock handle in a lower portion of the fenestration assembly, such as near the sill which permits easy access by individuals with limited access. For instance, elderly people in an assisting living arrangement, or people of shorter stature would be able to easily use the assembly. Further, the element 150 is concealed within the primary panel 112 to provide a decorative and aesthetically appealing configuration for the fenestration assembly. For instance, the element 150 is concealed by the exterior and interior surfaces 115, 117, respectively, of the primary panel 112 in one example (See FIGS. 1, 2, 4 and 5). In another example, the element 150 is concealed by the side (edge) surface 113 of the primary panel while the primary panel is in the open configuration relative to the frame 111 and the secondary panel 114 (See FIGS. 4 and 5). Stated another way, only the actuator assembly 120 and the locking latch assemblies 170 of the remotely operated locking system are visible whether the primary panel 112 is in the open or closed configuration. Covering of the element 150 further prevents interference with operation of the actuator assembly 120 and the locking latch assemblies, for instance because of debris or other matter on the element 150.

Figure 11:
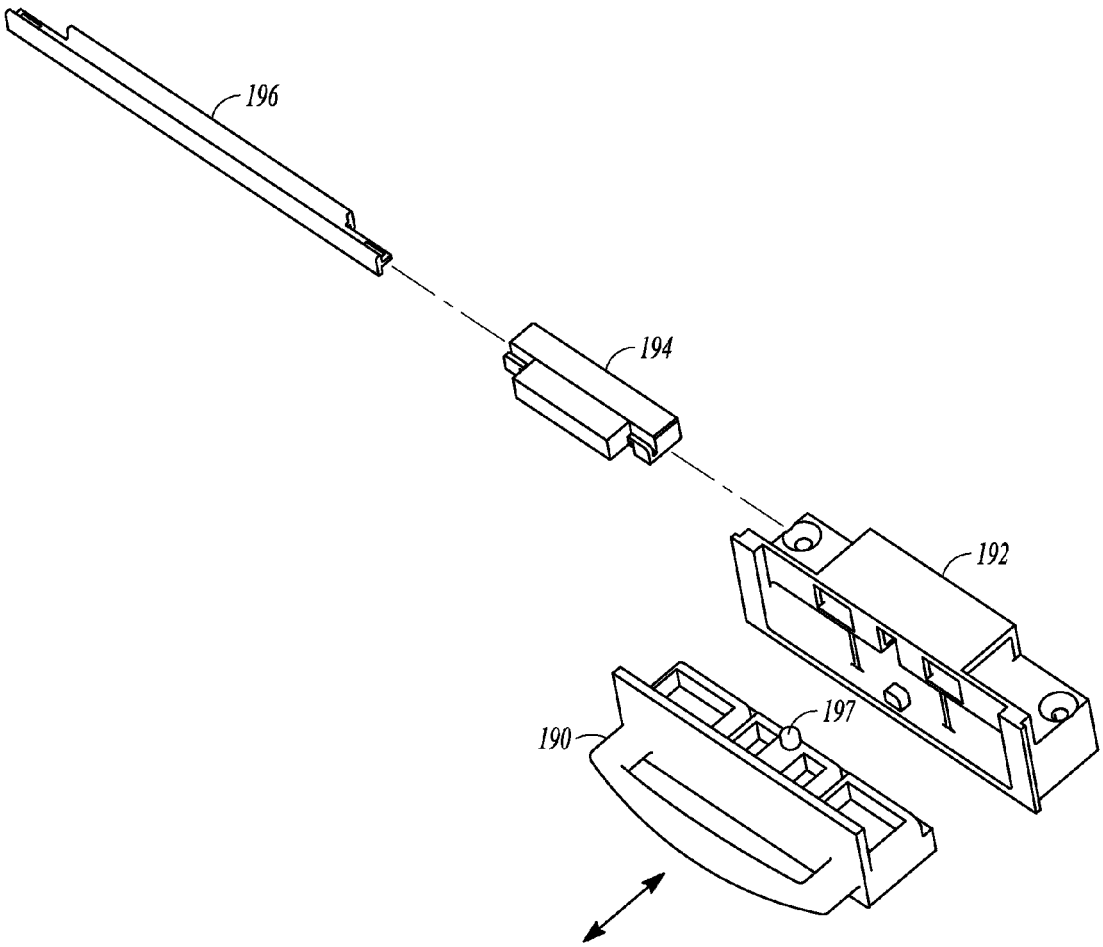
FIG. 11 is an exploded perspective view of an actuator assembly as constructed in accordance with at least one embodiment.
Figure 12:
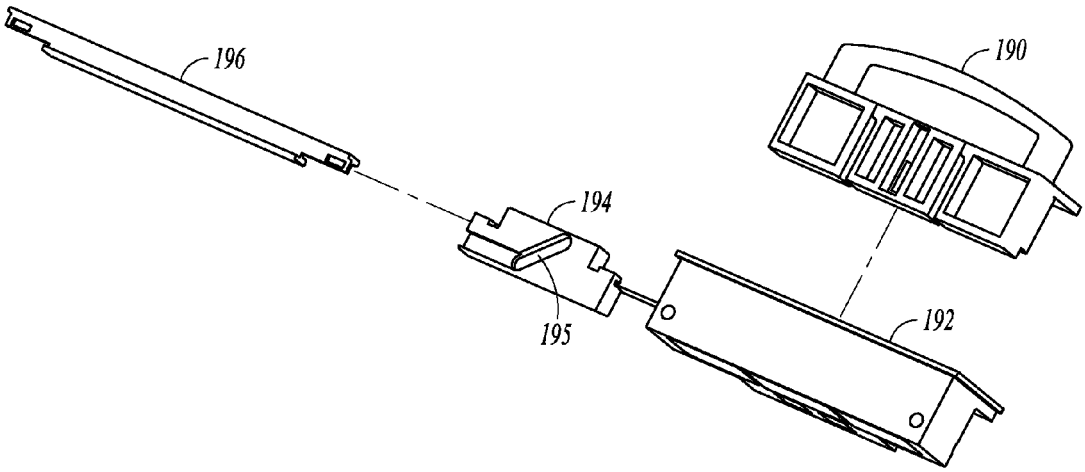
FIG. 12 is an exploded perspective view of an actuator assembly as constructed in accordance with at least one embodiment.

FIGS. 11 and 12 illustrate another option for the actuator assembly 120. The actuator 190, such as a handle, is received within a housing 192, and slides in an out of the housing 192, where the actuator 190 is biased toward a rear of the housing 192, for example with a spring, seating the handle within the housing 192. A pin 197 of the actuator 190 interacts with a slot 195 of a slide 194, which is coupled with element 196. Slide 194 is disposed within the housing 192, and is slidable relative to the housing 192. Element 196 can be a rigid structure, such as a rod, and is coupled with one or more locking latch assemblies. Translation movement of element 196 actuates the locking latch assemblies, as discussed above.

As the actuator 190 moves relative to the housing 192, for example in the direction of the arrows of FIG. 11, element 196 is translated, and locks and unlocks the locking latches. As the actuator 190 is pulled away from the housing 192, the pin 197 rides within slot 195, pulls the slide 194 toward the housing, causing translation of element 196, and unlocking of the locking latches. The actuator 190 is further pulled and slides open the panel. As the actuator 190 is released, a biasing element causes the actuator 190 to move toward the housing 192, releasing the slide 194 away from the housing, causing translation of element 196, and locking the locking latches when the panel is moved to a closed position.

Figure 13:
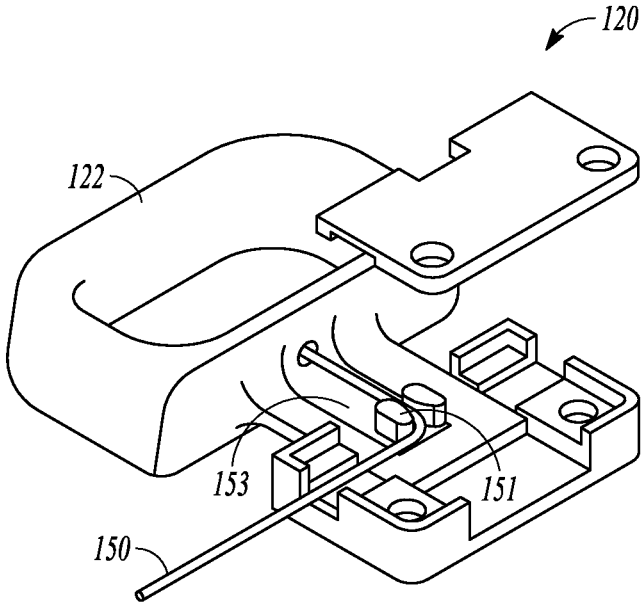
FIG. 13 is an exploded perspective view of an actuator assembly as constructed in accordance with at least one embodiment.
Figure 14:
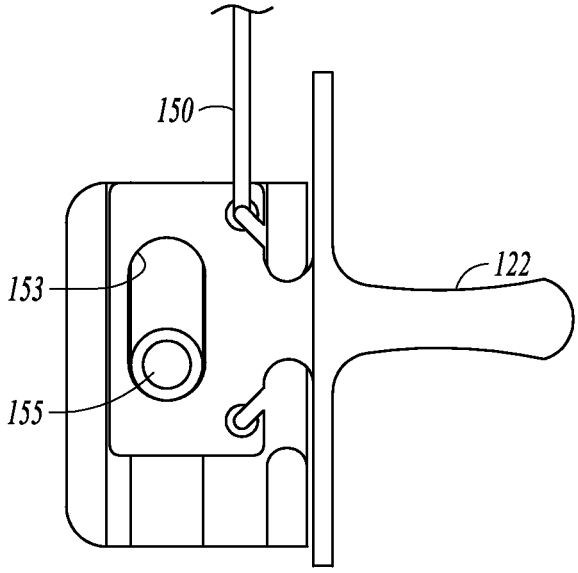
FIG. 14 is a side view of an actuator assembly as constructed in accordance with at least one embodiment.

FIGS. 13 and 14 illustrate additional embodiments. The actuator assembly 120 includes an actuator 122, for example, with a D-shape, as shown in FIG. 13. The actuator 122 can be sized to be grasped by a few fingers, or sized for a hand grip. The actuator 122 is coupled with element 150, which can be a cord, for example. The element 150 passes through or around a guide 151, which re-directs the element 150. As the actuator 122 is pulled, the element 150 pulls on the latch assemblies as discussed below. A housing and a housing cover plate encompass at least a portion of the guide 151 and the actuator 122, where the actuator 122 is slidable relative to the housing and includes a biasing member. The actuator 122 includes a slot 153 which receives the guide 151 therein.

FIG. 14 includes another embodiment of the actuator assembly 120. The actuator 122 is used to push in the direction of 123 to unlock the latches. As actuator 122 is pushed, element 150 translates in the same direction as the actuator 122, and unlocks the latching assemblies as discussed above. The housing includes a slot 153, which rides over a pin 155. A biasing member can be used to maintain the actuator 122 in the unpushed position.

A method of use includes grasping the actuator or handle, pulling on the handle, unlocking the latch assemblies, and sliding and opening the assembly all in one motion. In another option, the handle is initially lifted and/or rotated as the user pulls the primary sash across to open it. The latch assemblies, which can include multiple latch assemblies, are located remote to the handle, in an option.

Figure 16:
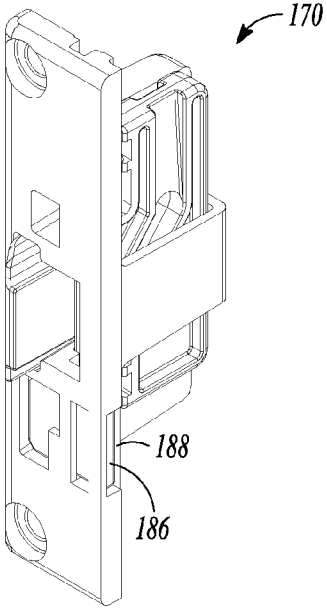
FIG. 16 is an assembled perspective view of a locking latch assembly as constructed in accordance with another embodiment.
Figure 15:
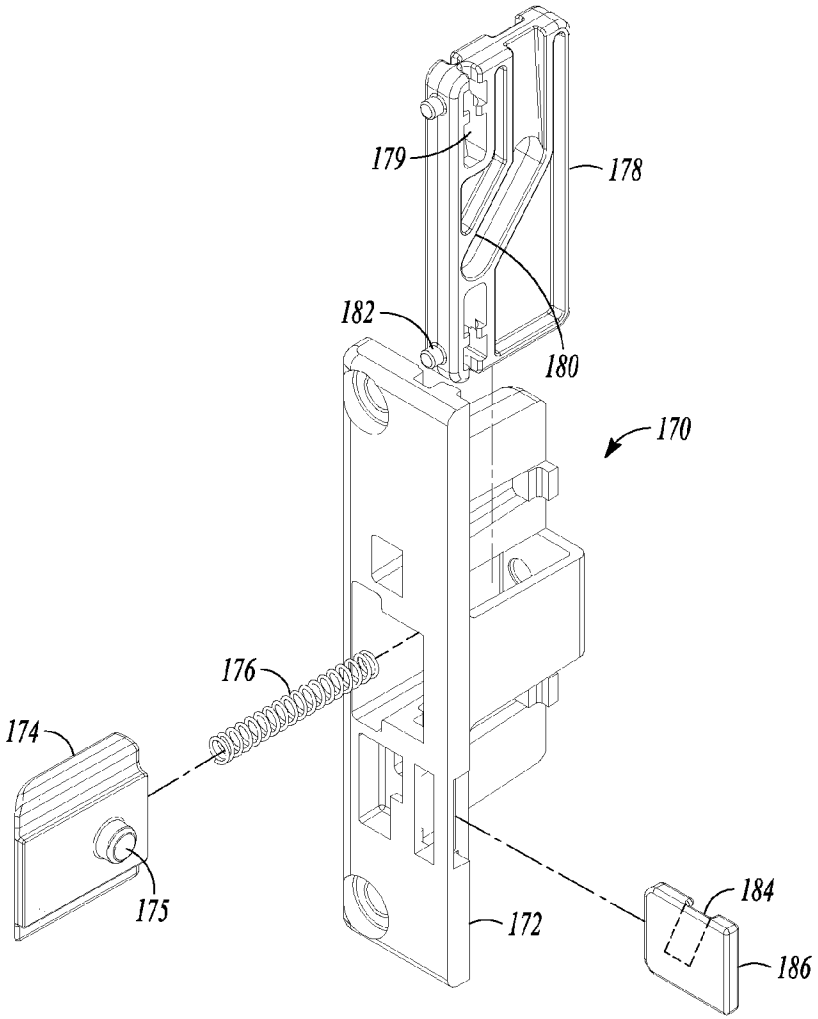
FIG. 15 is an exploded perspective view of a locking latch assembly as constructed in accordance with another embodiment.

The locking latch assemblies 170, shown in more detail in FIGS. 15 and 16 are similar in at least some regard to the locking latch assemblies 170 shown in FIGS. 6 and 7, and where appropriate similar reference numbers are attributed to similar features. The use of similar reference numbers is not intended to be limiting. As shown in FIG. 2, the locking latch assemblies 170 are remotely mounted relative to the actuator assembly 120. The locking latch assemblies 170 are interconnected with the flexible element 150 (e.g., a transmission element), and are further coupled with the actuator assembly 120 with the flexible element 150. Although a flexible element 150 is used in one example, a rigid element including a tie bar and the like may be used.

Figure 18:
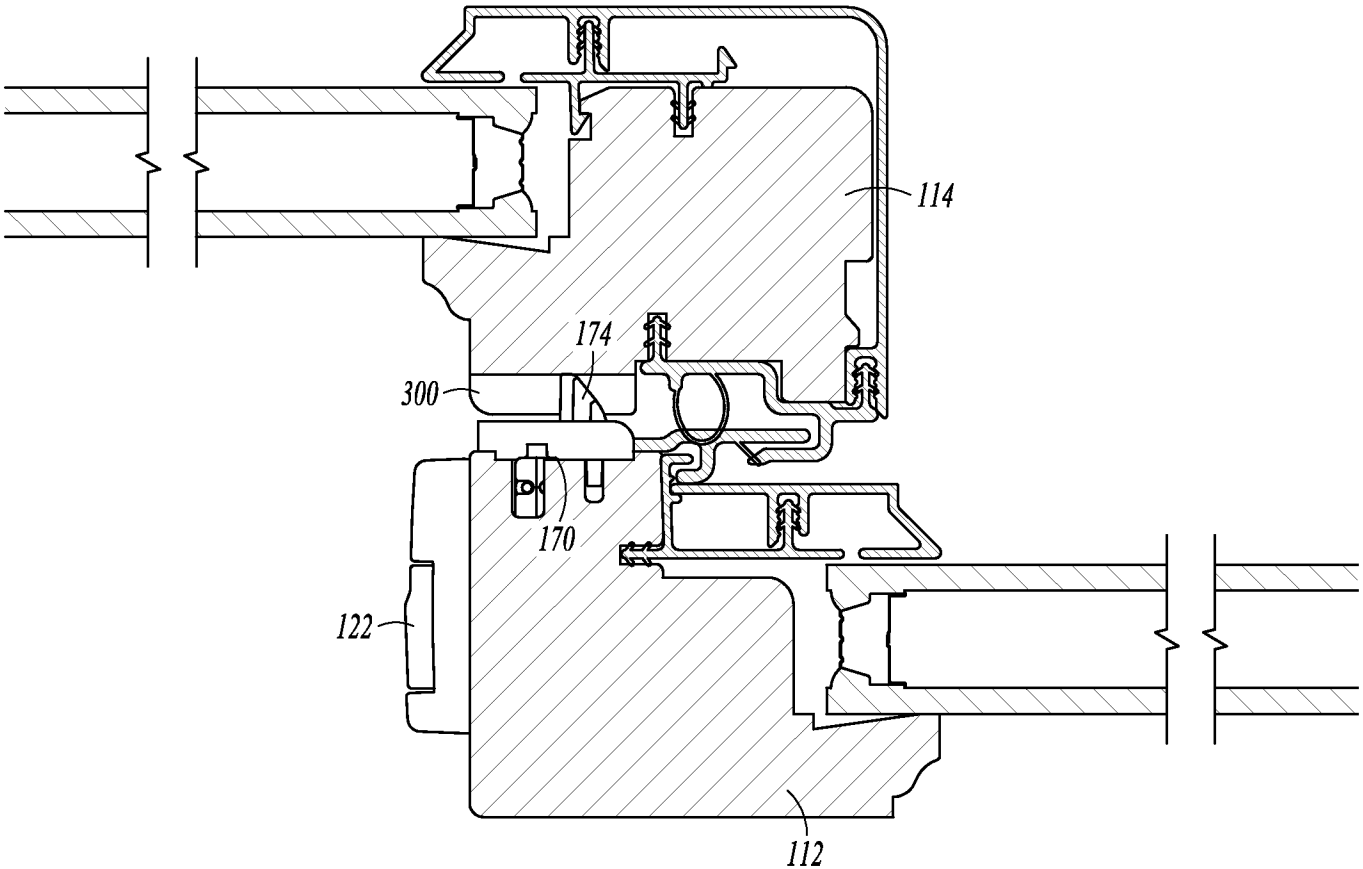
FIG. 18 is a cross-sectional view of a sliding fenestration assembly in the locked position as constructed in accordance with another embodiment taken along line A-A in FIG. 3.
Figure 19:
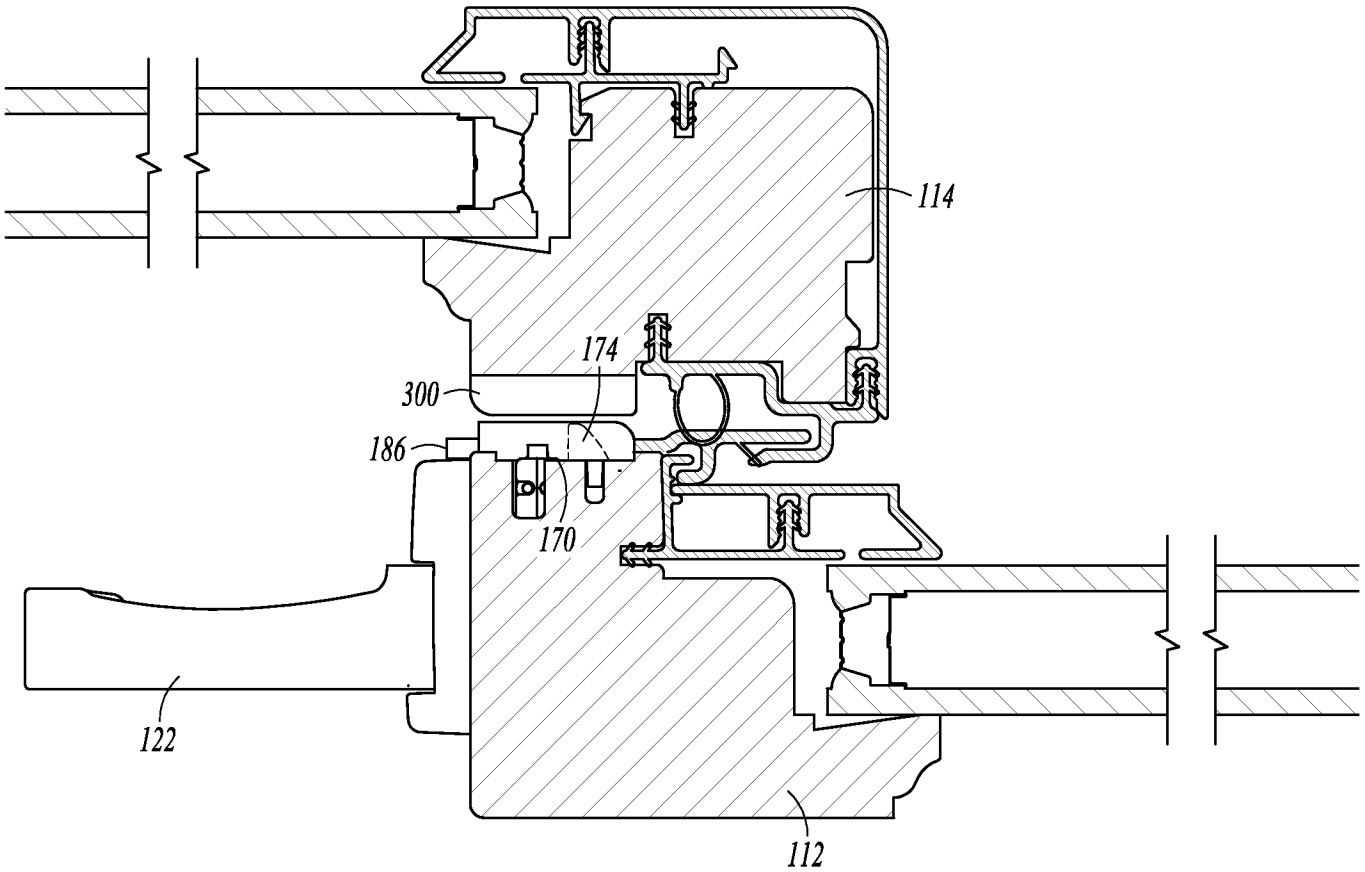
FIG. 19 is a cross-sectional view of a sliding fenestration assembly in the unlocked position as constructed in accordance with another embodiment taken along line A-A in FIG. 3.

In an option, the assemblies 170 include a lock latch housing 172 that receives a locking latch bolt 174 (e.g., a latch) and a biasing element, such as a spring 176, therein. The lock latch bolt 174 includes a pin 175 that rides within slot ramp 180 of the lock latch slide 178 (e.g., a lock latch cam slide). As described in further detail below, the slot ramp 180 is a cam slot sized and shaped to receive the pin 175 (e.g., a follower pin). The lock latch slide 178 moves relative to the housing 172 as the actuator 122 moves the flexible element 150. The flexible or rigid element 150 is coupled with the lock latch slide 178, for instance in slot 179, allowing for movement of the actuator and flexible or rigid element 150 to cause movement of the lock latch slide 178. As the pin 175 rides along slot ramp 180 due to movement of the lock latch slide 178, the pin 175 will ride down the ramp slot and retract the latch bolt 174. This moves the assembly 170 from a locked position where the bolt 174 projects from the primary panel 112, as shown in FIG. 18, to an unlocked position where the bolt 174 is retracted relative to the primary panel 112, as shown in FIG. 19. Stated another way, movement of the flexible element 150 by way of the actuator 122 correspondingly moves the lock latch slide 178 relative to the primary panel 112. The latch bolt 174 is thereby moved in and out of the lock latch housing 172 (or relative to the primary panel 112) according to cam movement between the slot ramp 180 and the pin 175. The biasing element, for instance spring 176, biases the latch bolt 174 into the locked position as the actuator 122 is returned to a closed position, shown in FIG. 2. Optionally, the latch bolt 174 and other features of the locking latch assemblies 170 are built directly into the primary panel 112 without the lock latch housing 172.

In another option, the lock latch slide 178 of the locking latch assemblies 170 includes slide pins 182 sized and shaped for reception in corresponding housing slots of the lock latch housing 172. In one example, the slide pins 182 guide the lock latch slide 178 during sliding movement within the lock latch housing 172. In another example, one or more of the slide pins 182 acts as an indicator pin received within an indicator cam slot 184 of an unlocked status indicator 186. As shown in FIG. 16, the unlocked status indicator 186 is received within an indicator orifice 188 of the lock latch housing 172. The unlocked status indicator 186 provides discrete notification to a user that one or more of the locking latch assemblies 170 is in the unlocked position, shown in FIG. 19. As will be discussed in detail below, the unlocked status indicator 186 provides notification according to the actual position of the lock latch bolt 174 it is coupled with. Stated another way, an individual unlocked status indicator 186 is directly tied to the lock latch bolt 174, and the indicator 186 remains presented and visible to a user where the lock latch bolt 174 is in the open position.

Referring again to FIGS. 15 and 16, the unlocked status indicator 186 is received within the lock latch housing 172. The unlocked status indicator is coupled with the lock latch bolt 174 according to respective reception of the pin 175 within the slot ramp 180 of the lock latch slide 178 and reception of a slide pin 182 within the indicator cam slot 184 of the unlocked status indicator 186 (e.g., a flag or similar visible feature). Once the lock latch bolt 174 is moved into the unlocked position (through operation of the actuator 122 and movement of the flexible element 150) the bolt 174 is withdrawn as shown in FIG. 19. As described above, movement of the lock latch slide 178 causes the withdrawal of the bolt 174 according to movement of the flexible element 150. The pin 175 follows the path of the slot ramp 180 according to the cam shape of the slot ramp. Movement of the slot ramp 180 is transmitted through the slide pin 182 to the unlocked status indicator 186. The indicator 186 is projected outwardly and visibly as shown in FIG. 19 according to the cam interfit between the slide pin 182 and the indicator cam slot 184. The user is thereby affirmatively notified that the lock latch bolt 174 of the locking latch assembly 170 associated with the particular unlocked status indicator 186 is in the open position.

The interrelated coupling of the lock latch bolt 174 with the unlocked status indicator 186 ensures visible notification of the locked and unlocked status of the individual locking latch assembly 170. As the actuator 122 is returned to the closed (locking position) the flexible element 150 moves the lock latch slide 178 thereby allowing the lock latch bolt 174 to return to the locked position shown in FIG. 18. As previously described, in one example, the lock latch bolt 174 is returned to the locked position according to bias from the spring 176. In another example, the lock latch bolt 174 is returned to the locked position according to cam movement between the slot ramp 180 and the pin 175. The unlocked status indicator 186 only withdraws to a position indicative of a return to the locked position where the lock latch bolt 174 has affirmatively returned to the locked position. The unlocked status indicator 186 must move into the orientation shown in FIG. 18 for the lock latch slide 178 to correspondingly move through the relation between the slot ramp 180 and the pin 175. Further, it is only with movement of the lock latch slide 178 that the slide pin 182 moves through the indicator cam slot 184 to thereby withdraw the unlocked status indicator 186 from view (the indicator is concealed in FIG. 18).

Importantly, the unlocked status indicator 186 only returns to a withdrawn position (e.g., not visible and indicative of a locked configuration) corresponding to the locked position of the adjacent lock latch bolt 174. Stated another way, the unlocked status indicator 186 is only concealed where the bolt 174 is in the locked position and not directly concealed according to the position of an actuator 122, the flexible element 150 or another lock latch bolt associated with a different locking latch assembly 170. The user is thereby provided an affirmative notification that the lock latch bolt 174 associated with the particular unlocked status indicator 186 is locked or unlocked. That is to say, false positives, such as the unlocked status indicator 186 in the concealed and thereby locked orientation while the lock latch bolt 174 is actually unlocked are prevented.

Multiple locking latch assemblies 170 can be unlocked with an actuator 122 which is remote from the locking assemblies 170, and further can be done with a single handed operation. This is helpful for larger units where the locking assemblies are too high for a user to reach, or in too difficult of a position for the user to reach, such as above a wide sink. The assembly allows for multiple lock points along the mating stiles to be unlocked or disengaged by using an actuation handle in one location. The single location of the actuation handle allows for locating the lock handle in a lower portion of the fenestration assembly, such as near the sill which permits easy access by individuals with limited access. For instance, elderly people in an assisting living arrangement, or people of shorter stature would be able to easily use the assembly. Stated another way, one or more of the locking latch assemblies 170 are positioned nearer a top surface of the frame 111 of the fenestration assembly (and primary panel) while the actuator assembly 120 is positioned nearer the bottom of the fenestration assembly frame (and primary panel).

Figure 17:
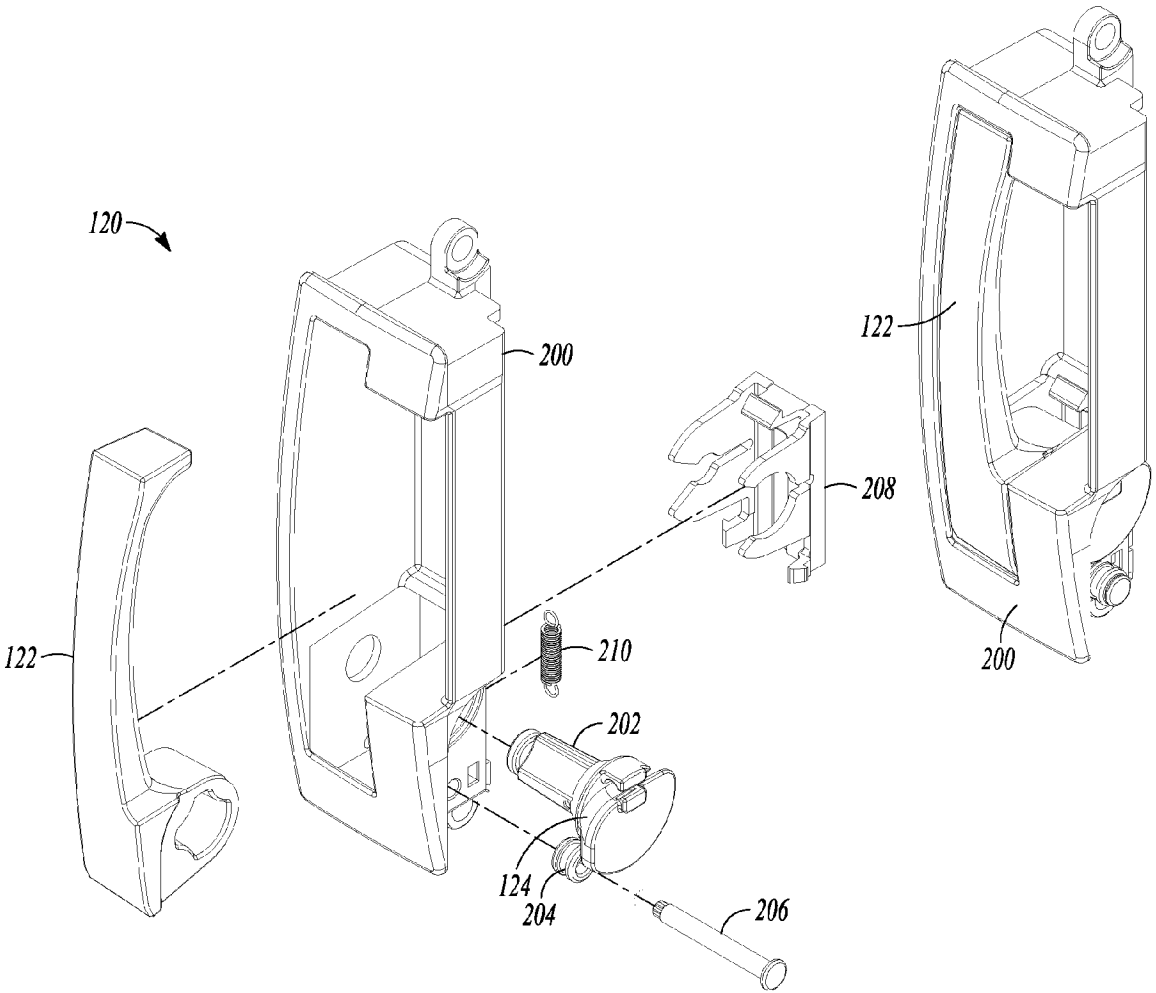
FIG. 17 is an exploded perspective view of an actuator assembly as constructed in accordance with another embodiment.

FIG. 17 shows perspective and exploded views of the actuator assembly 120. The actuator assembly 120 is similar in at least some regard to the actuator 120 shown in FIG. 8. Where similar features are included the corresponding numbered elements are the same. The use of similar reference numbers is not intended to be limiting. The actuator assembly 120 includes the actuator 122, for instance a rotatable handle. In other examples, the actuator 122 includes a pull handle, sliding handle and the like as described herein as well as their equivalents. The actuator 122 is coupled with an actuator housing 200. The actuator housing 200 is configured for coupling with the primary panel, such as the panel 112 shown in FIG. 1. In the example shown in FIG. 17, the actuator 122 is coupled with the actuator housing 200 with a spindle 202 that facilitates rotation of the actuator 122 relative to the housing 200. The spindle 202 includes a slot 124 for reception of a portion of the flexible element 150 (shown in FIG. 2). The flexible element 150 is wrapped around the spindle 202 and during operation of the actuator 122 the spindle 202 takes up or lets out the flexible element 150 according to locking or unlocking movement of the actuator 122. In another example, the actuator assembly 120 includes a bushing 204 and pin 206. The pin 206 rotatably couples the bushing 204 with the actuator housing 200. The flexible element 150 is engaged along at least a portion of the bushing 204 to assist in movement of the flexible element 150 during operation of the locking latch assemblies 170. Additionally, the bushing 204 minimizes wear on the actuator assembly 120. Optionally, the actuator assembly 120 includes an actuator retainer 208 configured to engage with the actuator housing 200 and the spindle 202 to retain the spindle 202 within the actuator housing 200. The actuator retainer 208 provides a tight coupling between the spindle 202 and the housing 200 (e.g., with deflectable mechanical tabs, adhesives, welds, interference fits and the like) while permitting rotation of the spindle.

In yet another example, the actuator assembly 120 includes a bias element, such as a spring 210. The spring 210 is coupled between the housing 200 and one of the handle 122 and the spindle 124 to assist in biasing the actuator 122 toward the closed position shown in the assembled perspective view in FIG. 17. The inclusion of the optional spring 210 assists the lock latch bolts 174 to move into the locked position as operation of the spring 210 biases the flexible element 150 and correspondingly moves the lock latch slides 178.

Figure 20:
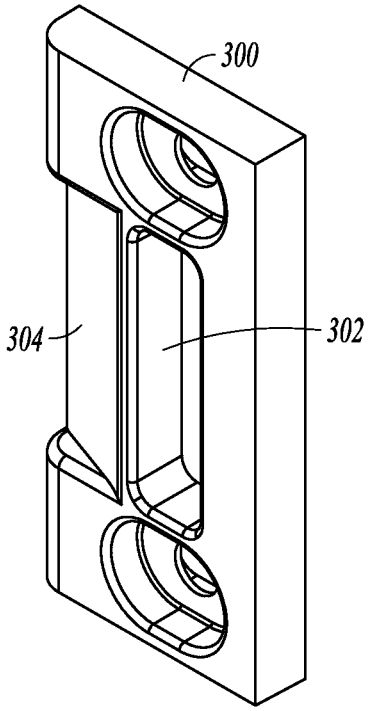
FIG. 20 is a perspective view of one example of a lock keeper.
Figure 21:
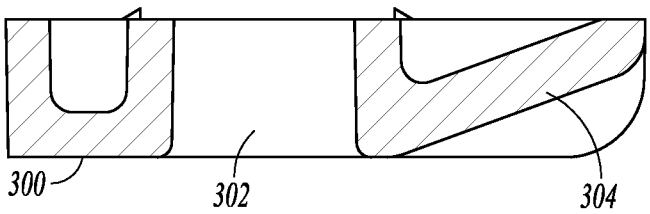
FIG. 21 is a cross sectional view of the lock keeper of FIG. 20.

FIGS. 20 and 21 show one example of a lock keeper 300 configured to engage with the lock latch bolt 174 while the bolt 174 is in the locked position shown in FIG. 18. Referring again to FIGS. 20 and 21, the lock keeper 300 includes a lock recess 302, and the lock keeper 300, in one example, is positioned on the secondary panel 114. The lock recess 302 is sized and shaped to receive the lock latch bolt 174 where the primary panel 112 is in the closed orientation relative to the secondary panel 114. When the actuator assembly 120 is operated and the lock latch bolts 174 of each of the locking latch assemblies 170 are moved into the unlocked position the bolts 174 are disengaged from the lock keepers 300 to permit movement of the primary panel 112. Where the lock latch bolts 174 are returned to the locked position (e.g., projecting as shown in FIG. 18) and the primary panel 112 is in an open configuration the user slides the primary panel 112 to the closed configuration. The projecting lock latch bolts 174 slide over the respective strike plates 304 (e.g., beveled surfaces) of each of the lock keepers 300 to deliver the bolts 174 into the lock recesses of each of the respective keepers. The strike plates 304 of the lock keepers 300 are constructed with, but not limited to, metal, durable plastic and the like. Alternatively, the strike plates are constructed with durable and finished wood or veneers to protect the underlying wood in the fenestration assembly. The strike plates 304 protect the underlying wood from wear and further provide a durable surface for locking engagement with the lock latch bolts 174 to improve the security of the fenestration assembly in the closed orientation.

In operation, the user operates (e.g., pulls) the actuator 122 relative to the primary panel 112 and the frame 111. For example, the user moves the actuator in a first direction relative to the panel 112 and the frame 111. The movement of the actuator 122 is transmitted to the locking latch assemblies 170 through the flexible element 150 (e.g., a transmission element). The lock latch slides 178 are correspondingly moved, and the lock latch bolts 174 are moved from the locked to the unlocked positions thereby freeing the primary panel 112 to slide relative to the frame 111. The user is then able to move the primary panel 112 through further movement of the actuator 122, for example in a second direction relative to the movement causing unlocking of the lock latch bolts 174. For example, after the actuator 122 is rotated outwardly from the fenestration assembly 100 (e.g., a first direction) the user pulls the actuator in a direction substantially parallel to the frame 111 to cause sliding movement of the primary panel 112 relative to the frame.

When closing and locking of the fenestration assembly 100 is desired the user grasps the actuator 122 and slides the primary panel to the closed configuration. The lock latch bolts 174 are received within corresponding features (e.g., lock recesses 302) of the secondary panel 114 to lock the primary panel 112 in place relative to the frame and the secondary panel. Alternatively, the locking latch assemblies 170 are configured for locking and unlocking with the frame 111. For example, the locking recesses 302 are provided on the frame 111 and the user operates the actuator assembly to remotely lock and unlock the primary panel 112 from the frame.

It is to be understood that the above description is intended to be illustrative, and not restrictive. For instance, any of the aforementioned examples may be used individually or with any of the other examples. Many other embodiments may be apparent to those of skill in the art upon reviewing the above description. The scope of the present fenestration assemblies and methods should, therefore, be determined with reference to the appended claims, along with the full scope of legal equivalents to which such claims are entitled. In the appended claims, the terms "including" and "in which" are used as the plain-English equivalents of the respective terms "comprising" and "wherein." Also, in the following claims, the terms "including" and "comprising" are open-ended, that is, a system, assembly, article, or process that includes elements in addition to those listed after such a term in a claim are still deemed to fall within the scope of such claim.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus the following claims are hereby incorporated into the Detailed Description, with each claim standing on its own as a separate embodiment.

What is claimed is:

1. A fenestration assembly comprising:

a frame;

a panel assembly including at least a primary panel and a secondary panel, the primary panel slidable relative to the secondary panel and the frame;

an actuator assembly mounted on the primary panel, the actuator assembly includes an actuator, the actuator assembly coupled with a transmission element, movement of the actuator causes movement of the transmission element;

two or more locking latch assemblies mounted along the primary panel, the two or more locking latch assemblies are coupled between the primary panel and the frame, and the actuator is remote from one or more of the two or more locking latch assemblies with the actuator positioned near a bottom of the primary panel and the two or more locking latch assemblies are nearer a top of the primary panel relative to the actuator, wherein:

the two or more locking latch assemblies are coupled with the actuator assembly through the transmission element, the two or more locking latch assemblies are movable between locked and unlocked positions, in the locked position the primary panel is fixed relative to the frame, and in the unlocked position the primary panel is slidable relative to the frame; and movement of the actuator is transmitted through the transmission element to each of the two or more locking latch assemblies, and movement of the actuator assembly moves each of the two or more locking latch assemblies between the locked and unlocked positions.

2. The fenestration assembly as recited in claim 1, wherein the actuator assembly includes a rotatable barrel, and the transmission element is wrapped around the barrel.

3. The fenestration assembly as recited in claim 1, wherein the actuator includes a lever.

4. The fenestration assembly as recited in claim 1, wherein the transmission element is a flexible element.

5. The fenestration assembly as recited in claim 1, wherein the transmission element is a rigid element.

6. The fenestration assembly as recited in claim 1, wherein the transmission element is concealed by exterior and interior surfaces of the primary panel, and the transmission element is concealed by a side surface of the primary panel.

7. The fenestration assembly as recited in claim 1, wherein one or more of the locking latch assemblies includes an unlocked indicator.

8. The fenestration assembly as recited in claim 1, wherein the unlocked indicator is movable between concealed and exposed positions, the exposed position corresponding to the unlocked position.

9. The fenestration assembly as recited in claim 1, wherein the unlocked indicator moves into the concealed position according to movement of a respective locking latch assembly from the unlocked position to the locked position.

10. A fenestration assembly comprising:

a frame;

a primary panel housed within the frame, the primary panel is slidable relative to the frame;

a secondary panel housed within the frame;

an actuator assembly coupled with the primary panel, the actuator assembly includes an actuator movably coupled with the primary panel;

two or more locking latch assemblies coupled with the primary panel, the locking latch assemblies each include:

a lock latch bolt movably coupled with the primary panel, the lock latch bolt includes a follower pin, and a lock latch slide slidably coupled with the primary panel, the lock latch slide includes a cam slot slidably coupling the follower pin with the lock latch slide;

one or more of the lock latch assemblies includes an unlocked indicator movably coupled with the lock latch slide, and the unlocked indicator moves according to movement of the lock latch bolt between the locked and unlocked positions, and the unlocked indicator includes an indicator cam slot, and the lock latch slide includes an indicator pin slidably received in the indicator cam slot;

a transmission element coupled between the actuator and the lock latch slide of each of the two or more locking latch assemblies; and movement of the actuator is transmitted through the transmission element to each of the lock latch slides, and movement of the lock latch slides moves the lock latch bolts between locked and unlocked positions, and in the unlocked position the primary panel is slidable within the frame.

11. The fenestration assembly as recited in claim 10, wherein in the locked position the lock latch bolts are engaged with the secondary panel.

12. The fenestration assembly as recited in claim 11, wherein the secondary panel includes lock keepers, and each of the lock keepers includes a lock recess for each of the lock latch bolts.

13. The fenestration assembly as recited in claim 12, wherein the lock keepers each include a beveled surface for slidable engagement with a respective lock latch bolt as the primary panel is moved from an open position to a closed position.

14. The fenestration assembly as recited in claim 10, wherein each of the two or more lock latch assemblies includes a lock latch housing, and each lock latch housing houses the lock latch bolt and the lock latch slide.

15. The fenestration assembly as recited in claim 10, wherein each of the two or more lock latch assemblies includes a bias element, and each bias element is coupled with a respective lock latch bolt, and the bias element biases the lock latch bolt toward a projecting orientation from the primary panel for the locked position.

16. The fenestration assembly as recited in claim 10, wherein in the unlocked position the unlocked indicator is visible, and the unlocked indicator is concealed by movement of the lock latch bolt from the unlocked position to the locked position.

17. The fenestration assembly as recited in claim 10, wherein each of the lock latch assemblies is spaced from other lock latch assemblies along the primary panel.

18. A fenestration assembly comprising:

a frame;

a primary panel housed within the frame, the primary panel is slidable relative to the frame;

a secondary panel housed within the frame;

an actuator assembly coupled with the primary panel, the actuator assembly includes an actuator movably coupled with the primary panel;

two or more locking latch assemblies coupled with the primary panel, the locking latch assemblies each include a lock latch bolt movably coupled with the primary panel, and the actuator is remote from one or more of the two or more locking latch assemblies with the actuator positioned near a bottom of the primary panel and the two or more locking latch assemblies are nearer a top of the primary panel relative to the actuator;

a transmission element coupled between the actuator and the two or more locking latch assemblies;

movement of the actuator is transmitted through the transmission element to each of the lock latch locking latch assemblies, and movement of the actuator moves the lock latch bolts between locked and unlocked positions, and in the unlocked position the primary panel is slidable within the frame; and wherein the primary panel is movable relative to the frame into open and closed positions:

in the closed position with the lock latch bolts in the locked position the primary panel is retained in the closed position, and in the open position with the lock latch bolts in the locked position the primary panel is movable to the closed position and automatically retains the primary panel in the closed position.

19. The fenestration assembly of claim 18, wherein the secondary panel includes lock recesses sized and shaped to receive the lock latch bolts therein.

20. The fenestration assembly of claim 19, wherein the secondary panel includes beveled surfaces to guide the lock latch bolts in to the lock recesses as the primary panel is moved from the open to the closed position.

21. The fenestration assembly of claim 20, wherein the lock recesses and the beveled surfaces are included in lock keepers.

22. The fenestration assembly of claim 18, wherein the lock latch bolts include a follower pin, and the two or more locking latch assemblies each include a lock latch slide slidably coupled with the primary panel, the lock latch slide includes a cam slot slidably coupling the follower pin with the lock latch slide.

23. The fenestration assembly as recited in claim 22, wherein one or more of the lock latch assemblies includes an unlocked indicator movably coupled with the lock latch slide, and the unlocked indicator is concealed or visible according to movement of the lock latch bolt between the locked and unlocked positions, respectively.

24. The fenestration assembly of claim 18, wherein the actuator is rotated to move the lock latch bolts between the locked and unlocked positions, and the actuator is pulled or pushed to move the primary panel between closed and open positions while the lock latch bolts are in the unlocked position.

* * * * *